US007468023B2

(12) United States Patent
Wu et al.

(10) Patent No.: US 7,468,023 B2
(45) Date of Patent: Dec. 23, 2008

(54) SUSPENSION SYSTEM FOR WALK TRAINING

(75) Inventors: Hung-Sheng Wu, Tuku Township, Yunlin County (TW); Chun-Ho Chen, Taiping (TW); Chih-Hun Hsu, Taichung (TW)

(73) Assignee: Cycling & Health Tech Industry R & D Center, Taichung (TW)

( * ) Notice: Subject to any disclaimer, the term of this patent is extended or adjusted under 35 U.S.C. 154(b) by 0 days.

(21) Appl. No.: 11/210,537

(22) Filed: Aug. 24, 2005

(65) Prior Publication Data

US 2007/0054784 A1 Mar. 8, 2007

(51) Int. Cl.
*A63B 22/00* (2006.01)

(52) U.S. Cl. ..... 482/69; 482/66

(58) Field of Classification Search ..... 482/66–69, 482/143, 51–54, 74

See application file for complete search history.

(56) References Cited

U.S. PATENT DOCUMENTS

| | | | | |
|---|---|---|---|---|
| 4,981,307 | A | 1/1991 | Walsh | 280/290 |
| 5,181,904 | A | 1/1993 | Cook et al. | 602/32 |
| 5,662,560 | A | 9/1997 | Svendsen et al. | 482/69 |
| 5,704,881 | A | 1/1998 | Dudley | 482/69 |
| 6,273,844 | B1 | 8/2001 | Kelsey et al. | 482/54 |
| 6,302,828 | B1 | 10/2001 | Martin et al. | 482/69 |

*Primary Examiner*—Fenn C Mathew
(74) *Attorney, Agent, or Firm*—Charles E. Baxley

(57) ABSTRACT

A suspension system for walk training in physical therapy is disclosed to include a framework formed of a top rail and two wheeled posts supporting the top rail, a suspension mechanism, which has a suspension rod suspending from the top rail by a suspension rope for securing a harness for a patient, a spring force control unit fixedly mounted in the framework for stretching the suspension rope and adjusting the stretch force to the suspension rope, an elevation adjustment unit fixedly mounted in the framework for adjusting the elevation of the suspension rod, and a suspension force measurement unit for measuring the pull force of the suspension rope.

1 Claim, 9 Drawing Sheets

SUSPENSION SYSTEM FOR WALK TRAINING

BACKGROUND OF THE INVENTION

1. Field of the Invention

The present invention relates to apparatus for physical therapy and more particularly, to a suspension system for walk training, which is conveniently adjustable to fit different users and different walk training requirements.

2. Description of the Related Art

Various gait training devices are known for physical therapy. Further, a suspension system may be used with a gait training device to help the patient when taking a walk training therapy. A conventional suspension system for this purpose simply uses a suspension mechanism to help the patient stand on the floor. This suspension mechanism is not vertically stretchable to match with the patient's walking motion.

In recent years, suspension systems having a vertically stretchable function have been developed to help patients in walk training. These suspension systems commonly use an elastic rope and a tensile spring to suspend a suspension rod. When in use, the patient is fastened with a harness and then the harness is hung on the suspension rod. However, these improved designs of suspension systems are still not satisfactory in function because they are not adjustable to fit different patients having different body heights or to fit different suspension requirements. Further, these suspension systems are commonly complicated and expensive, not economic to hospitals and patients.

SUMMARY OF THE INVENTION

The present invention has been accomplished under the circumstances in view. It is the main object of the present invention to provide a suspension system for walk training, which can conveniently be adjusted to change the elevation of the suspension rod to fit different users. It is another object of the present invention to provide a suspension system for walk training, which can conveniently be controlled to adjust the suspension force to fit different training requirements.

To achieve these and other objects of the present invention, the suspension system comprises a framework, the framework comprising two posts vertically arranged in parallel, a top rail horizontally connected between the posts, and two wheel assemblies respectively provided at the posts at a bottom side for moving the framework on a flat surface; a suspension mechanism, the suspension mechanism comprising a suspension rod suspending below the top rail, and a suspension rope mounted in the framework to suspend the suspension rod from the top rail; a spring force control unit fixedly mounted in the framework and connected with one end of the suspension rope for stretching the suspension rope and adjusting the stretch force to the suspension rope; an elevation adjustment unit fixedly mounted in the framework and adapted to move the suspension rope and to further adjust the suspension elevation of the suspension rod; and a suspension force measurement unit, the suspension force measurement unit comprising a pull force sensor connected in series to the suspension rope for measuring the pull force applied to the suspension mechanism.

DETAILED DESCRIPTION OF THE PREFERRED EMBODIMENT

Figure 1:
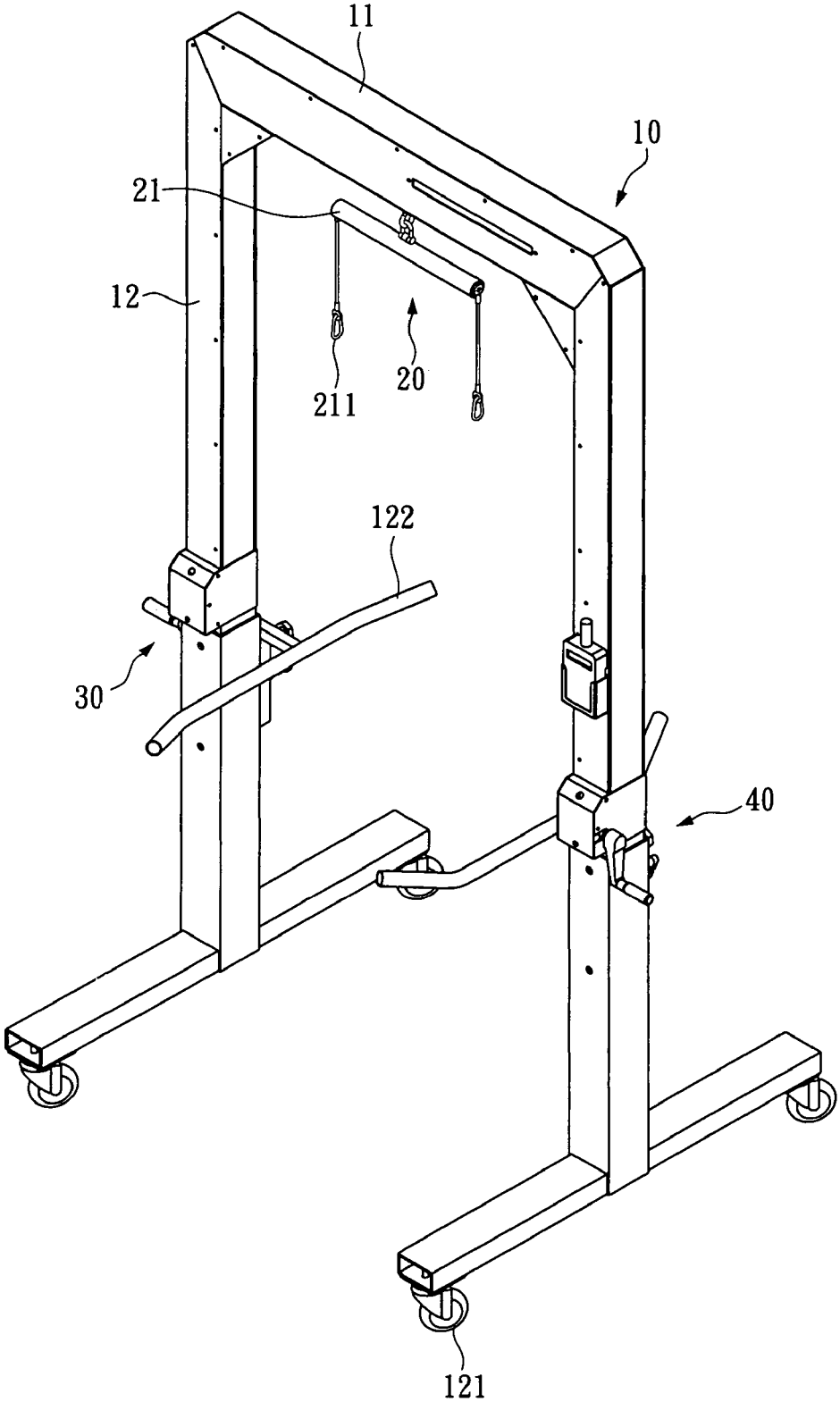
FIG. 1 is an elevational view of a suspension system according to the present invention.
Figure 2A:
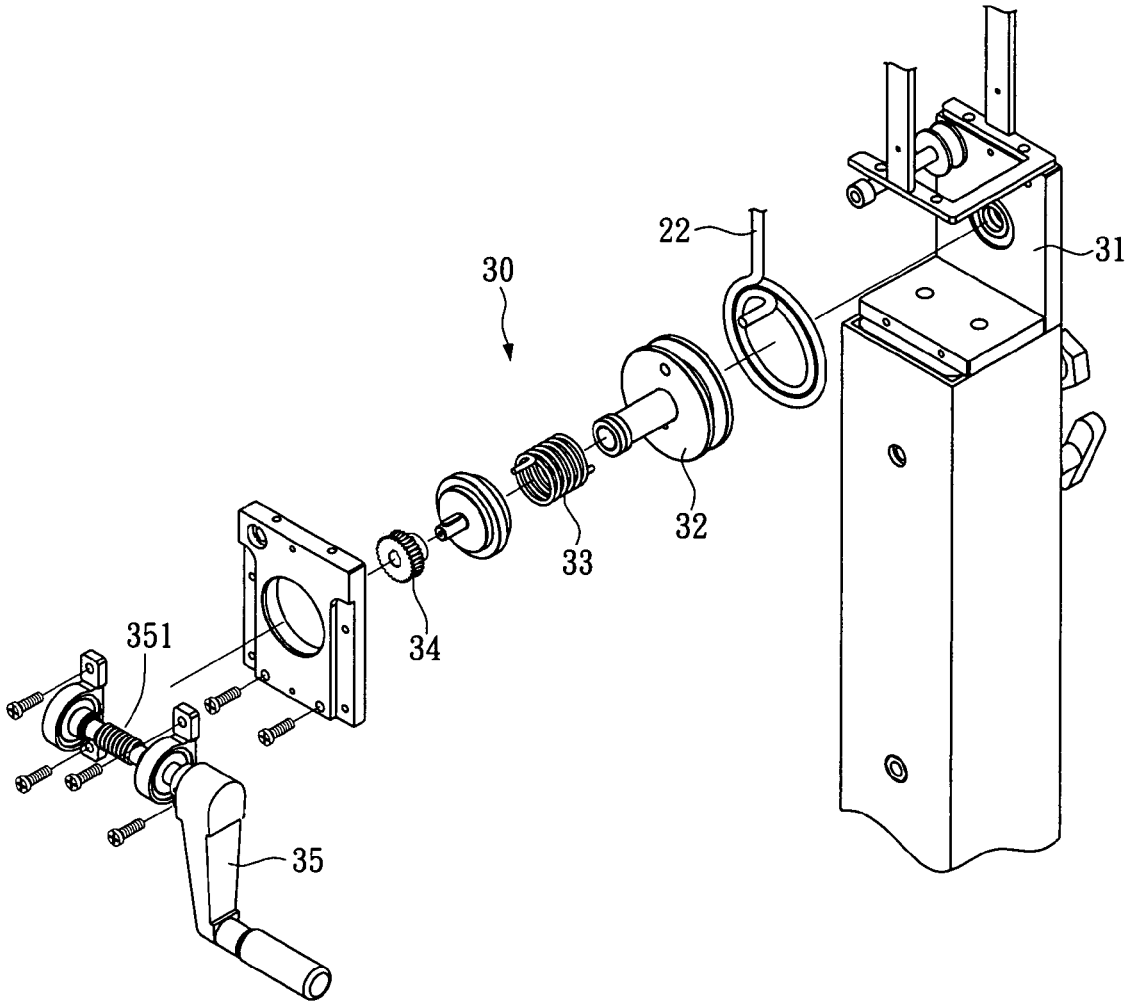
FIG. 2A is an exploded view in an enlarged scale of a part of the suspension system according to the present invention, showing the structure of the spring force control unit.
Figure 2B:
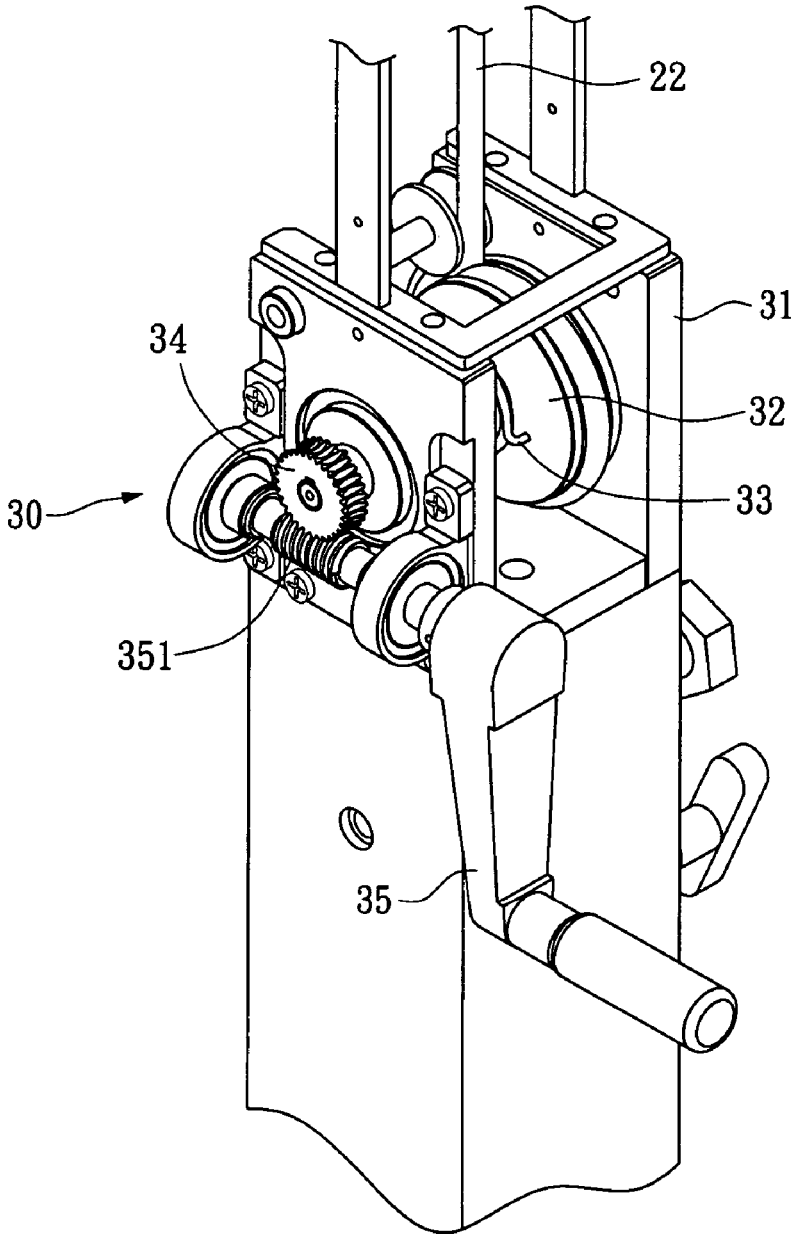
FIG. 2B is an assembly view of FIG. 2A.
Figure 3A:
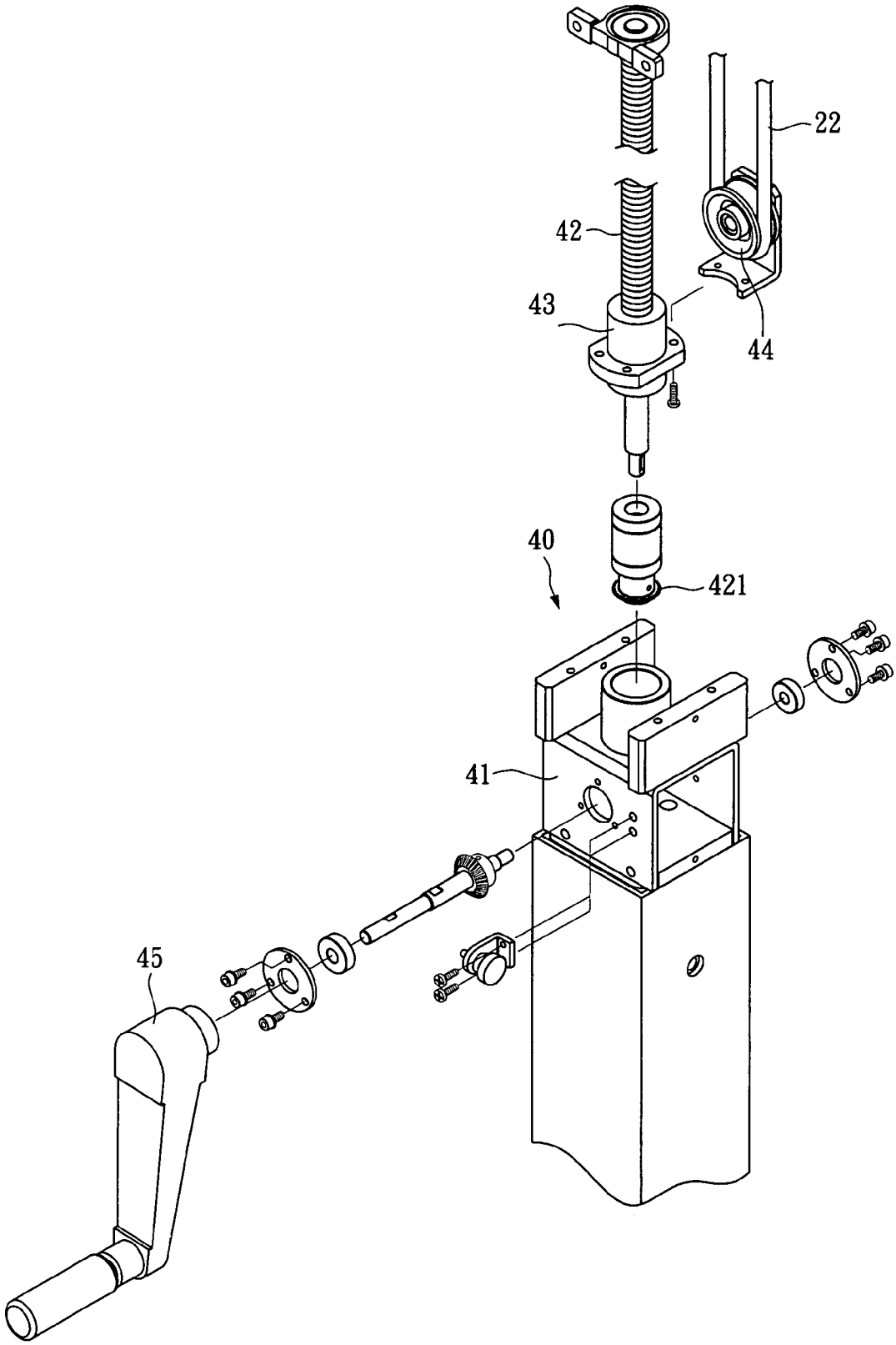
FIG. 3A is an exploded view in an enlarged scale of a part of the suspension system according to the present invention, showing the structure of the elevation adjustment unit.
Figure 3B:
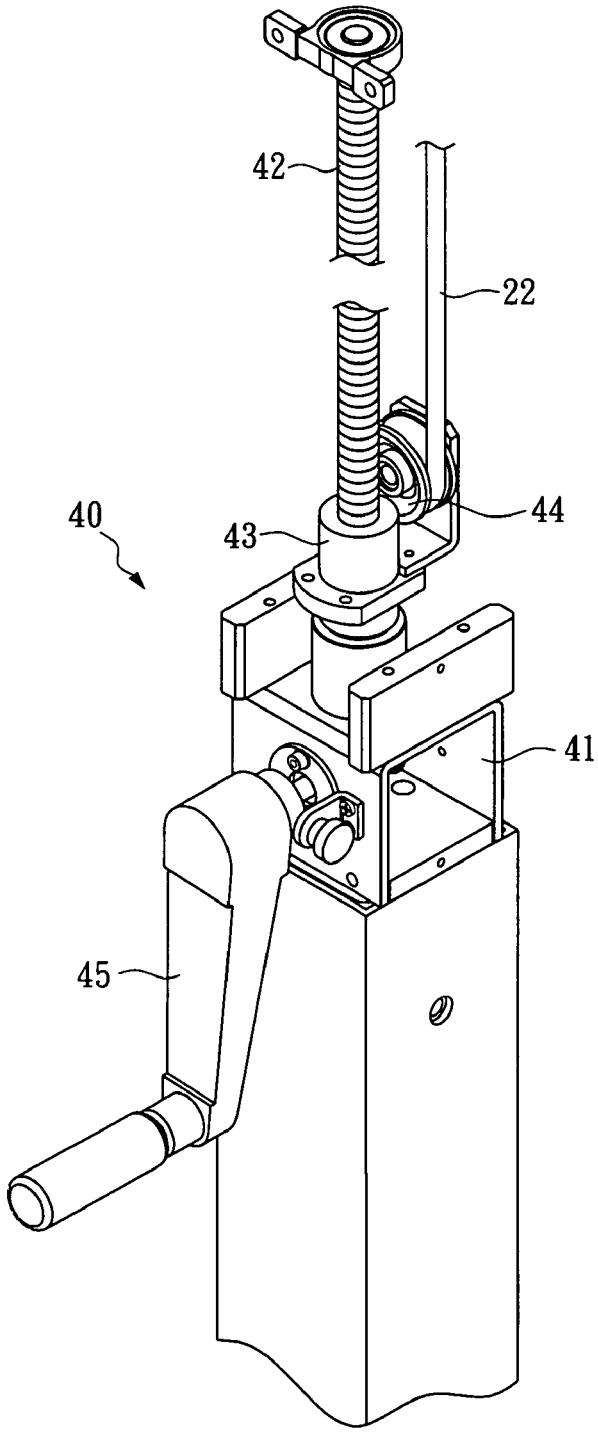
FIG. 3B is an assembly view of FIG. 3A.
Figure 4A:
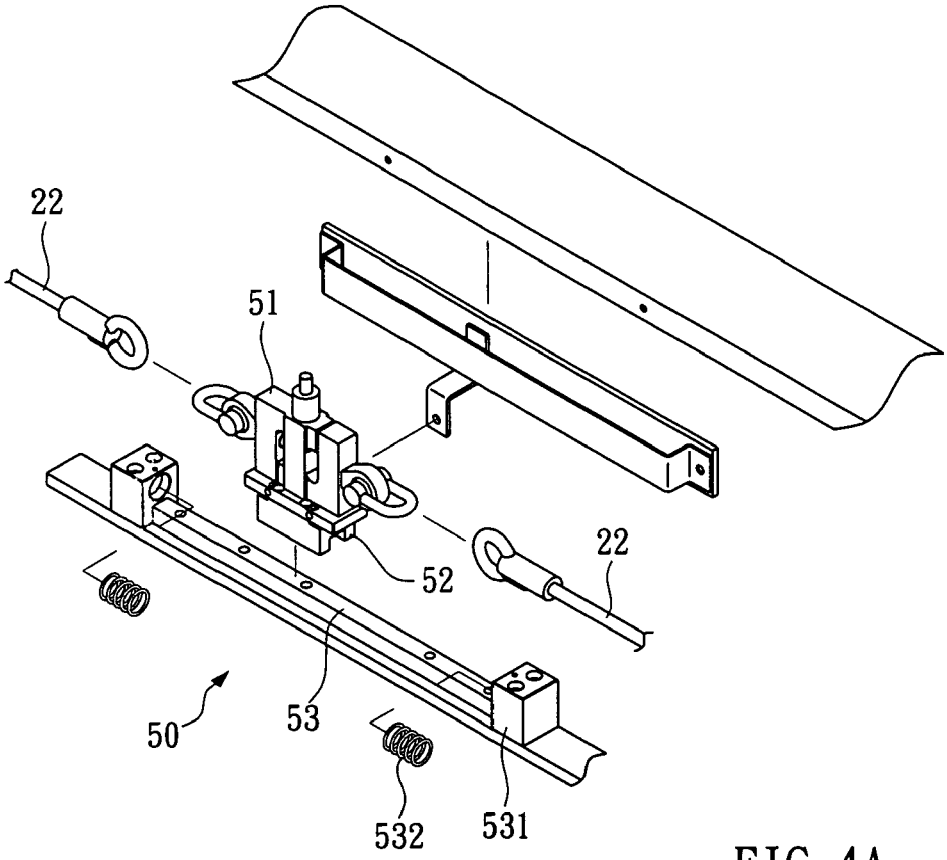
FIG. 4A is an exploded view in an enlarged scale of a part of the suspension system according to the present invention, showing the structure of the suspension force measurement unit.
Figure 4B:
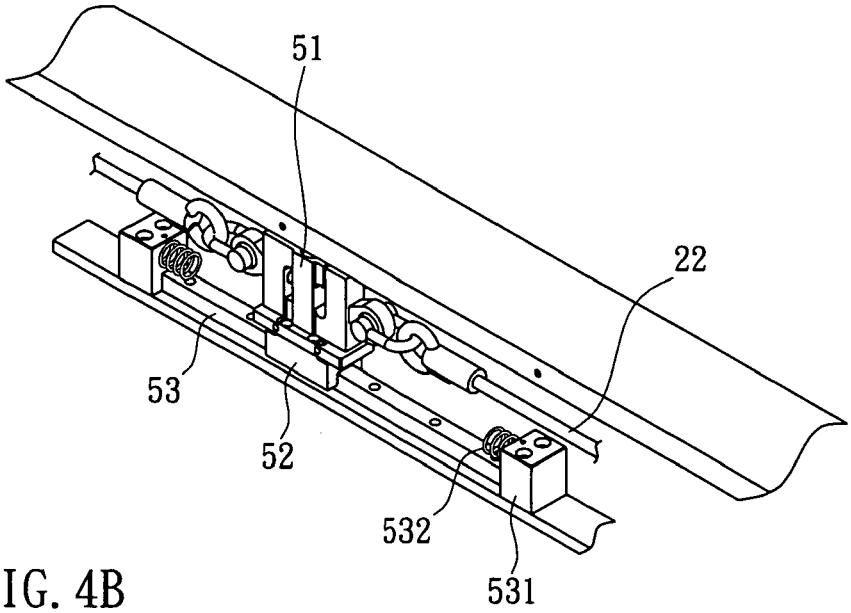
FIG. 4B is an assembly view of FIG. 4A.
Figure 5:
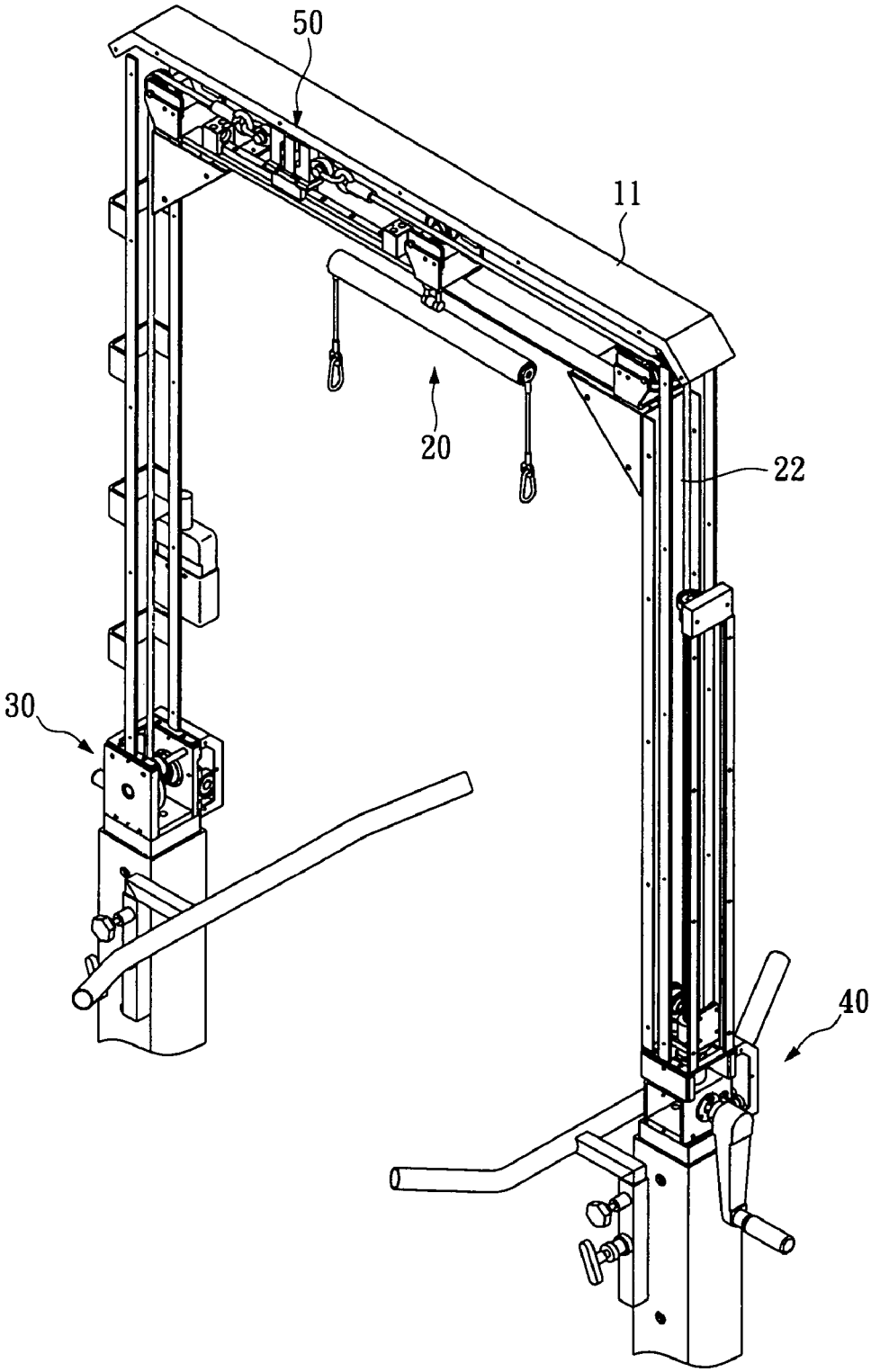
FIG. 5 is a cutaway view of the suspension system according to the present invention.

Referring to FIGS. 1~5, a suspension system for walk training in accordance with the present invention is shown comprised of a framework 10, a suspension mechanism 20, a spring force control unit 30, an elevation adjustment unit 40, and a suspension force measurement unit 50.

The framework 10 comprises a top rail 11, two posts 12 respectively connected to the two distal ends of the top rail 11 to hold the top rail 11 in horizontal, two wheel assemblies 121 respectively fastened to the posts 12 at the bottom side for allowing movement of the framework 10 on the floor conveniently, and two handrails 122 respectively adjustably provided at the posts 12 at a suitable elevation. According to this embodiment, the top rail 11 and the posts 12 are respectively formed of hollow frame bars.

Referring to FIG. 1 again, the suspension mechanism 20 comprises a suspension rod 21, two hanging hooks 211 respectively provided at the two distal ends of the suspension rod 21 for securing a harness (not shown) to be fastened to the patient who is going to take the walk-training exercise, and a suspension rope 22, which is inserted through the top rail 11 and has a first end extended out of a bottom center hole (not shown) of the top rail 11 and fixedly fastened to the midpoint of the suspension rod 20 and a second end extending through the elevation adjustment unit 40 in one of the two posts 12 and then extending through the top rail 11 into the inside of the other one of the two posts 12 and coupled to the spring force adjustment unit 30 (further, pulleys are used to guide movement of the suspension rope 22).

Referring to FIGS. 1, 2A, 2B and 5 again, the spring force control unit 30 comprises a holder frame 31 fixedly mounted inside one post 12, a winch 32 pivotally supported on the inside of the holder frame 31, a torsional spring 33, which is supported on (a shaft at) one side of the winch 32 and has a first end fixedly connected to one side of the winch 32 and a second end, a worm gear 34 pivotally mounted inside the holder frame 31 and fixedly connected to the second end of the torsional spring 33, a crank handle 35 pivotally mounted in the respective post 12, and a worm 351 fixedly provided at one end of the crank handle 35 and meshed with the worm gear 34. The second end of the aforesaid suspension rope 22 is connected to the winch 32. The torsional spring 33 imparts a biasing force to the winch 32, causing the winch 32 to roll up the suspension rope 22.

Referring to FIGS. 1, 3A, 3B and 5 again, the elevation adjustment unit 40 comprises a holder frame 41 fixedly mounted inside the other post 12, a vertical screw rod 42 pivotally mounted on the holder frame 41 at the top, a nut 43 threaded onto the vertical screw rod 42 above the holder frame 41, a pulley 44 fixedly fastened to the nut 43, a crank handle 45 pivoted to the respective post 12, and a bevel gear transmission mechanism 421 coupled between the crank handle 45 and the bottom end of the vertical screw rod 42. Rotating the crank handle 45 clockwise/counter-clockwise will rotate the vertical screw rod 42, thereby causing the pulley 44 to be moved with the nut 43 upwards/downwards along the vertical screw rod 42. Further, the aforesaid suspension rope 22 extends over the pulley 44 and connected between the suspension rod 21 and the winch 32. Therefore, rotating the crank handle 45 can adjust the elevation of the suspension rod 21.

Referring to FIGS. 4A, 4B and 5 again, the suspension force measurement unit 50 comprises a pull force sensor 51, which is mounted inside the top rail 11 and has two ends connected in series to the suspension rope 22 for measuring the suspension force of the suspension mechanism 20, a track 53 fixedly mounted inside the top rail 11 and extending along the length of the top rail 11, a slide 52 fixedly provided at the bottom side of the pull force sensor 51 and coupled to and movable along the track 53, two stop blocks 531 respectively provided at the track 53 near the two ends of the track 53 to limit the moving distance of the slide 52 on the track 53, and two buffer springs 532 respectively provided at the stop blocks 531 and facing the slide 52 for buffering the striking force of the slide 52.

Figure 6:
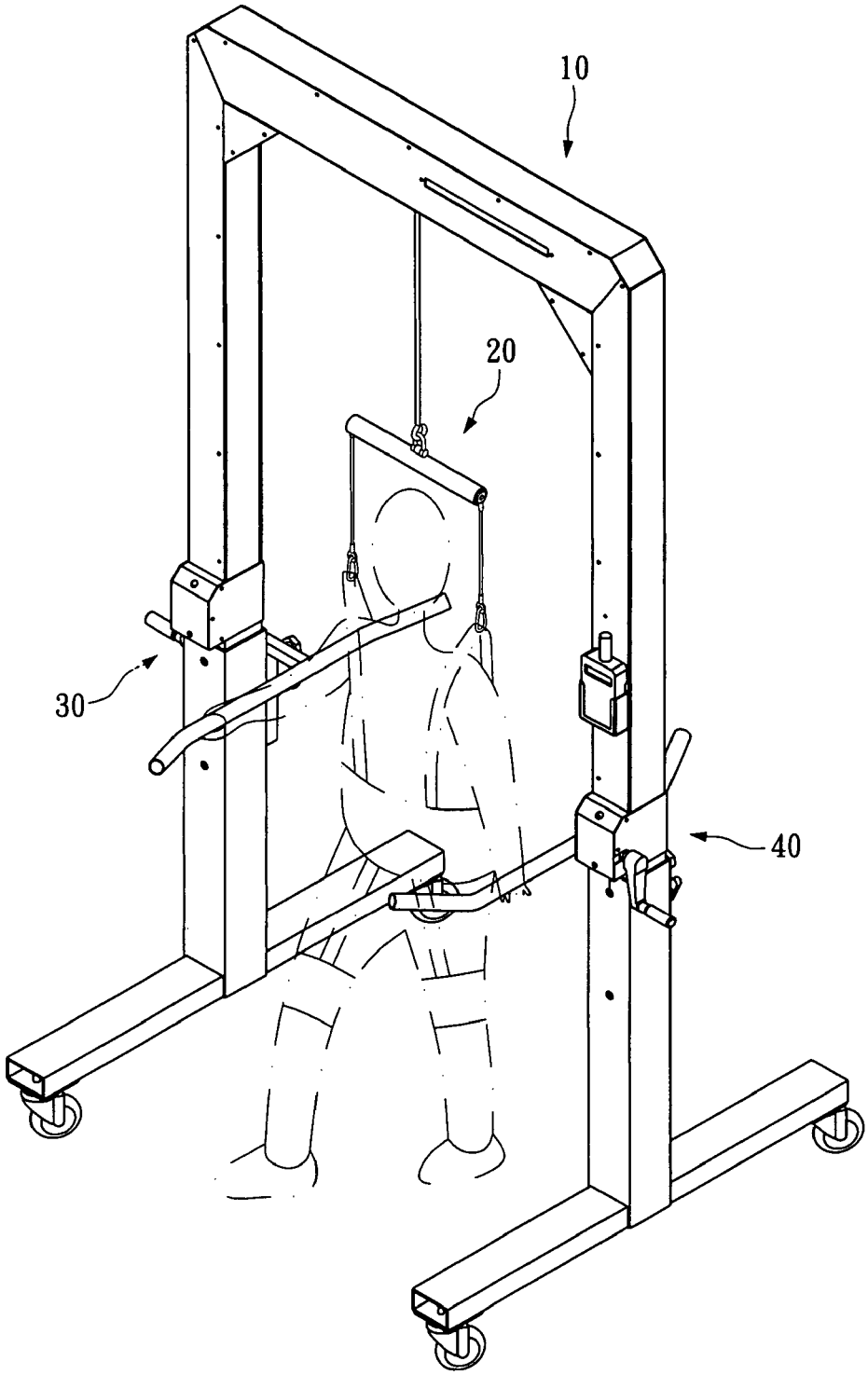
FIG. 6 is a schematic drawing showing one application example of the present invention.
Figure 7:
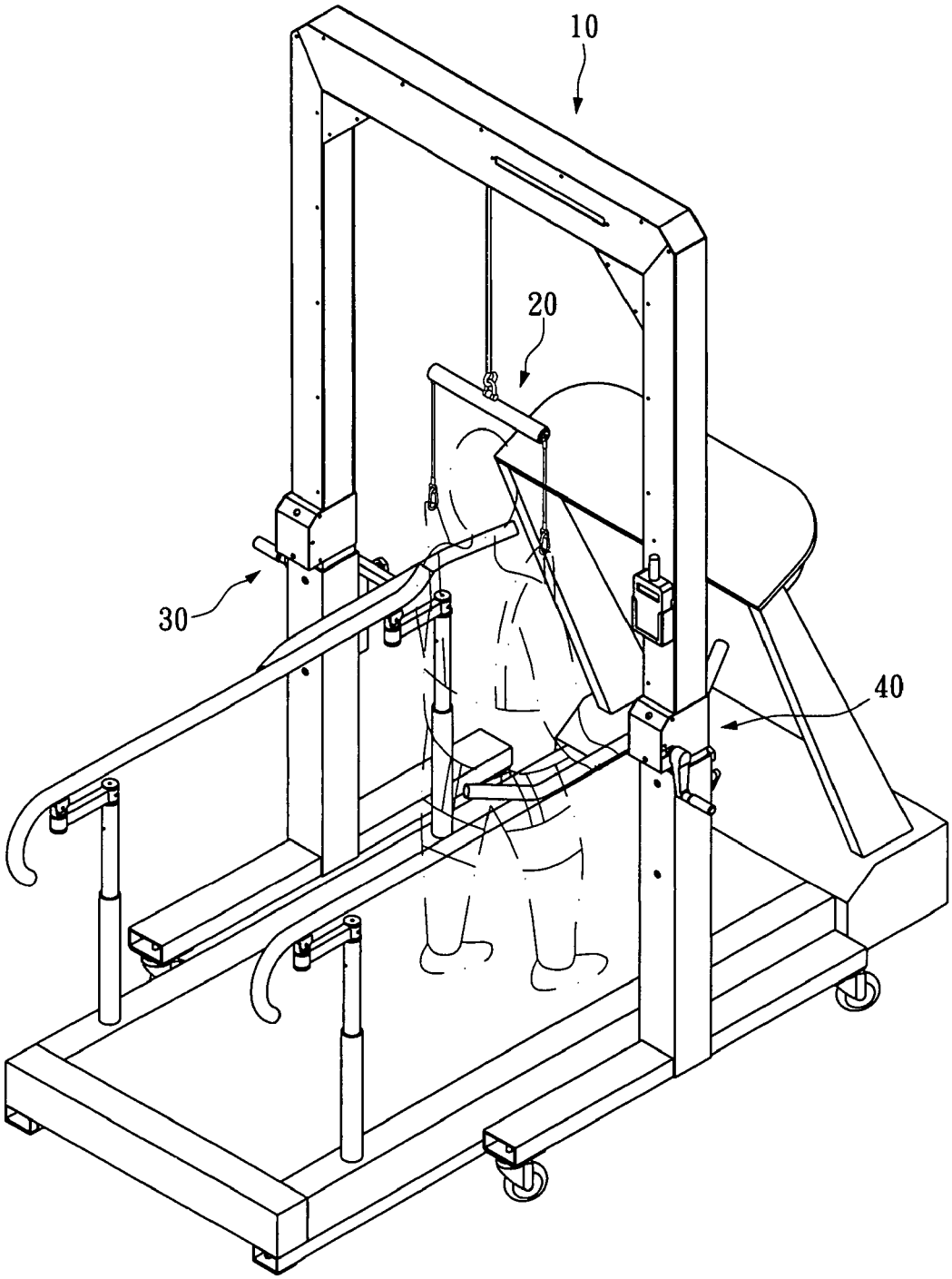
FIG. 7 is a schematic drawing showing another application example of the present invention.

The use of the present invention will be outlined hereinafter with reference to FIGS. 6 and 7 and FIG. 1 again. After the harness has been fastened to the patient's body, the hanging hooks 211 of the suspension mechanism 20 are fastened to the harness by means of the help of the therapist or another person. At this time, the patient can stand up and hold the handrails 122 with the hands, and then start to walk (see FIG. 6) or to run on a treadmill (see FIG. 7).

Referring to FIGS. 2A and 2B again, because the suspension rope 22 has one end coupled to the winch 32 and the torsional spring 33 imparts a biasing force to the winch 32 to roll up the suspension rope 22, the suspension rod 21 is smoothly moved up and down following the movement of the patient.

Further, the therapist can operate the crank handle 35 to rotate the worm gear 34, so as to further adjust the spring force of the torsional spring 33 subject to different operation requirements. Further, the engagement between the worm gear 34 and the worm 351 is automatically locked, preventing reverse rotation of the winch 32. Lock means to automatically lock the engagement between the worm gear 34 and the worm 351 can easily be achieved by means of conventional techniques. Therefore, the therapist can easily adjust the suspension force of the suspension mechanism 20, controlling the vertical moving range of the suspension rod 21 to fit different walk training requirements for different patients.

Referring to FIGS. 3A, 3B and 5 again, the therapist can operate the crank handle 45 of the elevation adjustment unit 40 to pull or release the suspension rope 22 and to further adjust the elevation of the nut 43 and the pulley 44, so as to further adjust the elevation of the suspension rod 21 of the suspension unit 20. When lowering the elevation of the pulley 44, the suspension rod 21 is relatively lifted. On the contrary, when lifting the pulley 44, the suspension rod 21 is relatively lowered.

Referring to FIGS. 4A and 4B again, the pull force sensor 51 of the suspension force measurement unit 50 is connected in series to the suspension rope 22 of the suspension mechanism 20. During operation of the suspension system, the indicator or display means (not shown) that is electrically connected to the pull force sensor 51 automatically indicates the suspension force of the suspension mechanism 20. Further, the stop blocks 531 and the buffer springs 532 limit the moving distance of the slide 52 on the track 53, preventing falling of the patient during walk training.

A prototype of suspension system has been constructed with the features of FIGS. 1~7. The suspension system functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A suspension system comprising:

a framework, said framework comprising two posts vertically arranged in parallel, a top rail horizontally connected between said posts, and two wheel assemblies respectively provided at said posts at a bottom side for moving said framework on a flat surface;

a suspension mechanism, said suspension mechanism comprising a suspension rod suspending below said top rail, and a suspension rope mounted in said framework to suspend said suspension rod from said top rail;

a spring force control unit fixedly mounted in said framework and connected with one end of said suspension rope for stretching said suspension rope and adjusting the stretch force to said suspension rope;

an elevation adjustment unit fixedly mounted in said framework and adapted to move said suspension rope and to further adjust the suspension elevation of said suspension rod, and a suspension force measurement unit, said suspension force measurement unit comprising a pull force sensor connected in series to said suspension rope for measuring the pull force applied to said suspension mechanism, wherein said pull force sensor of said suspension force measurement unit is suspending inside said top rail, having two ends connected in series to said suspension rope, wherein said suspension force measurement unit further comprises a track fixedly mounted inside said to rail, and a slide fixedly provided at a bottom side of said pull force sensor and coupled to and movable along said track, wherein said suspension force measurement unit further comprises two stop blocks respectively provided at said track near two ends of said track and adapted to limit the moving distance of said slide on, and two buffer springs on said track and wherein said suspension force measurement unit further comprises two buffer springs respectively provided at said stop blocks and facing said slide.

* * * * *